US005465981A

United States Patent [19]

Klaus

[11] Patent Number: 5,465,981

[45] Date of Patent: Nov. 14, 1995

[54] FLEDGING VANE

[75] Inventor: Emmerich Klaus, Veitsbronn, Germany

[73] Assignee: "Amerika-Bogen" Handelsgesellschaft mbH, Duisburg, Germany

[21] Appl. No.: 374,509

[22] Filed: Jan. 13, 1995

[30] Foreign Application Priority Data

Apr. 23, 1992 [DE] Germany ..... 9205525 U

[51] Int. Cl.[6] ..... F42B 6/06

[52] U.S. Cl. ..... 273/423

[58] Field of Search ..... 273/423, 420

[56] References Cited

U.S. PATENT DOCUMENTS

| | | | |
|---|---|---|---|
| 3,595,579 | 7/1971 | Benoit | 273/423 |
| 3,815,916 | 6/1974 | Meszaros . | |
| 3,895,802 | 7/1975 | Bear . | |
| 4,234,192 | 11/1980 | Salamone | 273/423 |
| 4,502,692 | 3/1985 | Humphrey | 273/423 |
| 4,510,109 | 4/1985 | Carella | 273/423 X |
| 5,039,110 | 8/1991 | Honda | 273/423 |

FOREIGN PATENT DOCUMENTS

| | | | |
|---|---|---|---|
| 2232246 | 12/1974 | France . | |
| 9591 | of 1901 | United Kingdom | 273/423 |
| 1201488 | 8/1970 | United Kingdom . | |
| 13808227 | 2/1973 | United Kingdom . | |

*Primary Examiner*—Paul E. Shapiro

*Attorney, Agent, or Firm*—Spencer, Frank & Schneider

[57] ABSTRACT

An arrow vane cut from a web of elastically deformable material has a main body portion intended to extend generally radially from an arrow shaft. Two mounting feet are bent from the main body portion along the lower edge thereof for mounting the vane to an arrow. The two feet are displaced longitudinally along the length of the main body portion and are bent away therefrom in opposite directions causing the main body portion to become S-shaped along its length when applied to an arrow shaft.

7 Claims, 1 Drawing Sheet

FLEDGING VANE

The invention relates to a fledging vane consisting of an elastically deformable material.

Such fledging vanes are commercially available—for example, they consist of plastics and are embodied as injection moulded parts. When an arrow is fledged with such vanes, to stabilize the arrow's flight by a spin thereof, mostly the longitudinal axis of the vane is directed slightly oblique relative to the long axis of the arrow shaft before fixing the vane by glueing it. As to the size of the vane, a compromise between the air resistance (small vane) and the spin generation (large vane) has to be found.

It is an object of the invention to provide a fledging vane which in small size generates a surprisingly large spin and the production of which is simplified besides this.

This object is solved by the features as given in claim 1.

It is evident that the cutting-out—preferably stamping-out—of the vane is cost-reducing as compared to a production by a moulding process. Preferably, the vane is fixed to the arrow shaft by glueing it thereto; herein, it has to be paid attention to the condition that the adhesive used is compatible to the material of the vane. Especially, if weather proof plastics are used, no long-term brittling of the material induced by the interaction with the adhesive may happen. Furthermore, sharp bends of the vane body have to be avoided.

Since the portion of the fold line between the vane body and the flaps at least at the time of the fixation is exposed to an elastical bias, during the fixation a propeller-kind deformation of the vane body happens so that the arrow experiences a considerable spin, even if the axis of the vane which coincides with the fold line between body and flaps is glued parallel to the arrow shaft axis. Of course it is also possible to glue on the vane obliquely to the arrow shaft axis, thereby even increasing the spin.

All vanes of the complete fledging of an arrow shaft should be fixed "equi-directionally", i.e. all of them should cause a spin in the same direction.

An embodiment of the subject-matter of the invention is shown in the enclosed figures and will be explained below referring to the figures.

Figure 2:
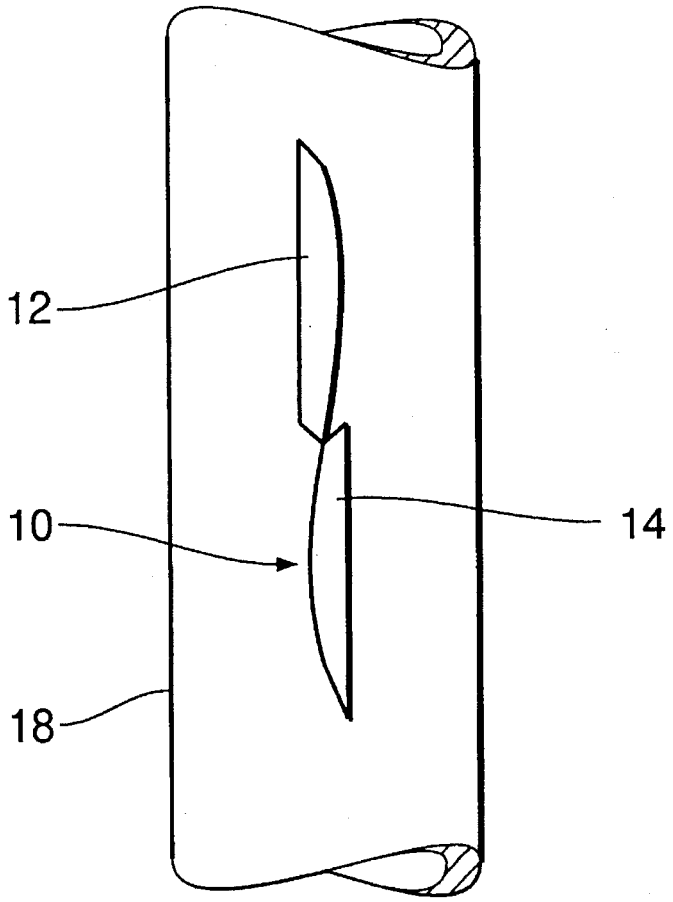
Figure 1:
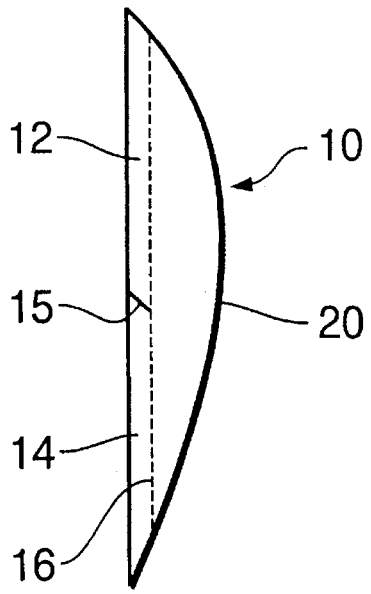
Figure 3:
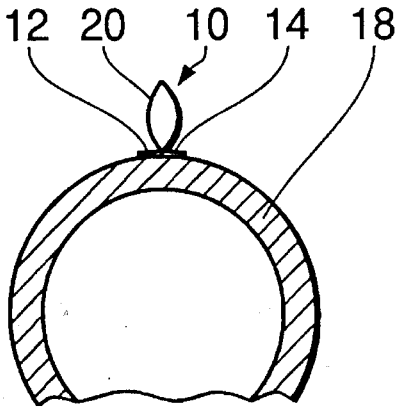

FIG. 1 shows the cut of a vane according to the invention prior to the bending of the flaps, FIG. 2 is a partial top view of an arrow shaft with a vane fixed thereto, and FIG. 3 is a partial view of the arrow shaft according to FIG. 2.

The cut as shown in FIG. 1 comprises a preferably asymmetrically designed body 10 and two fastening flaps 12, 14 being formed by a short incision 15. For fastening them to the arrow shaft 18, the flaps immediately prior to the glueing are bent with respect to a fold line 16, namely, the flap 12 in the top view of FIG. 2 to the left, and the flap 14 to the right (this is valid for "right-archers"; for "left-archers" the bending is carried out in the opposite direction). The bending portion is elastically biased so that the outer contour 20 of the body in the top view assumes an S-shaped line when the flaps are glued on the arrow shaft 18.

It is self-evident that the contour of the vane body as shown has to be understood as an example only and can be modified in many ways; in general, however, the traditional shape which tapers in direction to the arrowhead will be the most advantageous one.

The contour of the flaps is so designed that there will be no undercutting which could cause tearing of the vane during the strike of a vane onto an arrow already sticking in the target. The incision 15 is so designed that during the glueing, if possible, no "gap" is formed between the vane body and the arrow shaft; should the situation arise, such gap had to be sealed to avoid the generation of whirls.

I claim:

1. Fledging vane consisting of elastically deformable material characterized in that the vane is cut-out of a material web and comprises a vane body and two fastening flaps being arranged one behind the other in arrow shaft direction and being bent-in opposite directions to each other.

2. Vane according to claim 1, characterized in that the flaps are glueable on an arrow shaft.

3. Vane according to claim 1, characterized in that the portion of the fold line between the body and the flaps is exposed to an elastical bias.

4. Vane according to claim 1, characterized in that it is stamped of weather proof plastics.

5. Vane according to claim 1, characterized in that the flaps are separated from each other by means of an incision.

6. Method for fledging an arrow shaft using a vane according to claim 1, characterized in that the vane is fastened in an orientation of the fold line connecting the flaps with the body parallel to the shaft axis.

7. Arrow shaft with a fledging of vanes according to claim 1, characterized in that the front flaps of all vanes are bent in one direction and the back flaps of all vanes are bent in the other direction.

* * * * *

UNITED STATES PATENT AND TRADEMARK OFFICE

CERTIFICATE OF CORRECTION

PATENT NO. : 5,465,981

DATED : Nov. 14, 1995

INVENTOR(S) : Emmerich Klaus

It is certified that error appears in the above-indentified patent and that said Letters Patent is hereby corrected as shown below:

On title page, item [22] should read as follows:

[22] PCT Filed: Apr. 20, 1993 and the following should be added:

[86] PCT No.: PCT/EP93/00970
371 Date: Jan. 13, 1995
102(e) Date: Jan. 13, 1995

[87] PCT Pub. No.: WO93/22613
PCT Pub. Date: Nov. 11, 1993

Signed and Sealed this

Second Day of April, 1996

*Attest:*

*Attesting Officer*

BRUCE LEHMAN

*Commissioner of Patents and Trademarks*